US008680790B2

(12) United States Patent
Jackson et al.

(10) Patent No.: US 8,680,790 B2
(45) Date of Patent: Mar. 25, 2014

(54) ELECTRICAL CONNECTOR FOR CONNECTING A LIGHT EMITTING DIODE (LED) TO A DRIVER

(75) Inventors: Stephen M. Jackson, Mount Joy, PA (US); Mohammad S. Ahmed, Harrisburg, PA (US); Robert Rix, Hershey, PA (US); Matthew Mostoller, Hummelstown, PA (US); Gerald Wingle, Reinholds, PA (US); John Akins, Chicago, IL (US)

(73) Assignee: Tyco Electronics Corporation, Berwyn, PA (US)

( * ) Notice: Subject to any disclaimer, the term of this patent is extended or adjusted under 35 U.S.C. 154(b) by 384 days.

(21) Appl. No.: 13/045,206

(22) Filed: Mar. 10, 2011

(65) Prior Publication Data

US 2012/0229043 A1 Sep. 13, 2012

(51) Int. Cl.
*H05B 37/02* (2006.01)

(52) U.S. Cl.
USPC ..... 315/309; 315/297; 315/312

(58) Field of Classification Search
USPC ..... 315/291, 294, 297, 307, 309, 312
See application file for complete search history.

(56) References Cited

U.S. PATENT DOCUMENTS

| | | | | |
|---|---|---|---|---|
| 7,322,718 | B2 | 1/2008 | Setomoto et al. | |
| 8,350,500 | B2 * | 1/2013 | Negley et al. | 315/309 |
| 2007/0222390 | A1 * | 9/2007 | Huang | 315/82 |
| 2009/0013570 | A1 | 1/2009 | Grajcar | |
| 2009/0085494 | A1 * | 4/2009 | Summerland | 315/291 |
| 2009/0179595 | A1 * | 7/2009 | Hite et al. | 315/308 |
| 2010/0033113 | A1 | 2/2010 | Maruyama et al. | |

OTHER PUBLICATIONS

International Search Report, International Application No. PCT/US2012/028486, International Filing Date, Sep. 3, 2012.

* cited by examiner

*Primary Examiner* — Tung X Le

(57) ABSTRACT

An electrical connector is provided for connecting a light emitting diode (LED) to a driver. The electrical connector includes a housing, a driver input contact held by the housing and configured to be electrically connected to a power output of the driver, and an LED output contact held by the housing and configured to be electrically connected to a power input of the LED. An electrical path is defined between the driver input contact and the LED output contact for supplying electrical power from the driver to the power input of the LED. The electrical connector includes a temperature monitor and control (TMC) module operatively connected to a temperature sensor for receiving a temperature associated with the LED. The TMC module is configured to control the flow of electrical power from the driver input contact to the LED output contact based on the temperature received from the temperature sensor.

20 Claims, 3 Drawing Sheets

ELECTRICAL CONNECTOR FOR CONNECTING A LIGHT EMITTING DIODE (LED) TO A DRIVER

BACKGROUND OF THE INVENTION

The subject matter described and/or illustrated herein relates generally to light emitting diodes (LEDs).

LEDs are being used to replace other lighting systems that use other types of light sources, such as incandescent or fluorescent lamps. LEDs offer advantages over lamps, for example rapid turn-on, rapid cycling (on-off-on) times, long useful life span, low power consumption, narrow emitted light bandwidths that eliminate the need for color filters to provide desired colors, and so on. LEDs are among the longest lasting light sources now available, for example with a useful life span measured in tens of thousands of hours. But, LEDs do experience a gradual reduction in light output over a life span, which is commonly referred to as "light output degradation." Light output degradation may result from a reduction in the light emitting efficiency of the LED and/or from a reduction in the light transmission of the optical path within an LED.

Relatively high operating temperatures may adversely affect the performance of LEDs. For example, relatively high operating temperatures may increase the rate of light output degradation experienced by LEDs, which may shorten the useful life span of an LED and/or decrease the light output of the LED at a given point in time during the life span. Accordingly, it is important to draw heat away from LEDs to reduce the rate of light output degradation experienced thereby, such as by using a heat sink, fan, and/or the like. One particular area where operating temperatures need to be controlled to prevent adversely affecting the performance of an LED is a junction within the LED. Specifically, LEDs typically include p-type and n-type semiconductors joined together at a junction. Relatively high temperatures generated at the junction of the LED may be especially problematic with respect to increasing the rate of light output degradation experienced by the LED.

LEDs within LED lightings systems are electrically connected to drivers that supply direct current (DC) electrical power to the LEDs for driving operation thereof. The drivers of some known LED lighting systems include control circuitry that monitors and controls the operating temperatures of the LEDs. But, a driver that includes such control circuitry may monitor and control the temperature of only a limited number of LEDs, or groups of LEDs. For example, some known LED lighting systems include a plurality of lighting modules, wherein each lighting module includes a plurality of LEDs. When control circuitry is provided within a driver for monitoring and controlling LED operating temperatures, the driver may be limited to monitoring and controlling the LED operating temperatures of only a single lighting module of the lighting system. In other words, a dedicated driver is required to monitor the LED operating temperatures of each lighting module, which may increase a cost, complexity, installation time, and/or the like of the lighting system.

BRIEF DESCRIPTION OF THE INVENTION

In one embodiment, an electrical connector is provided for connecting a light emitting diode (LED) to a driver. The electrical connector includes a housing, a driver input contact held by the housing and configured to be electrically connected to a power output of the driver, and an LED output contact held by the housing and configured to be electrically connected to a power input of the LED. An electrical path is defined between the driver input contact and the LED output contact for supplying electrical power from the driver to the power input of the LED. The electrical connector includes a temperature monitor and control (TMC) module operatively connected to a temperature sensor for receiving a temperature associated with the LED. The TMC module is configured to control the flow of electrical power from the driver input contact to the LED output contact based on the temperature received from the temperature sensor.

In another embodiment, a light emitting diode (LED) interconnection system is provided. The system includes an LED module having an LED and a temperature sensor. The LED includes a power input. The temperature sensor is configured to measure a temperature of at least a portion of the LED module. The system includes an electrical connector for connecting the LED module to a driver. The electrical connector includes a driver input contact configured to be electrically connected to a power output of the driver, and an LED output contact electrically connected to the power input of the LED. An electrical path is defined between the driver input contact and the LED output contact for supplying electrical power from the driver to the power input of the LED. The electrical connector includes a temperature monitor and control (TMC) module operatively connected to the temperature sensor for receiving the measured temperature of the at least a portion of the LED module. The TMC module is configured to control the flow of electrical power from the driver input contact to the LED output contact based on the measured temperature received from the temperature sensor.

In another embodiment, a light emitting diode (LED) interconnection system includes a driver configured to generate electrical power. The driver includes a power output. The system also includes an LED module having an LED and a temperature sensor. The LED includes a power input. The temperature sensor is configured to measure a temperature of at least a portion of the LED module. The system includes an electrical connector for connecting the LED to the driver. The electrical connector includes a driver input contact electrically connected to the power output of the driver, and an LED output contact electrically connected to the power input of the LED. An electrical path is defined between the driver input contact and the LED output contact for supplying electrical power from the driver to the power input of the LED. The electrical connector includes a temperature monitor and control (TMC) module operatively connected to the temperature sensor for receiving the measured temperature of the at least a portion of the LED module. The TMC module is configured to control the flow of electrical power from the driver input contact to the LED output contact based on the measured temperature received from the temperature sensor.

DETAILED DESCRIPTION OF THE INVENTION

Figure 1:
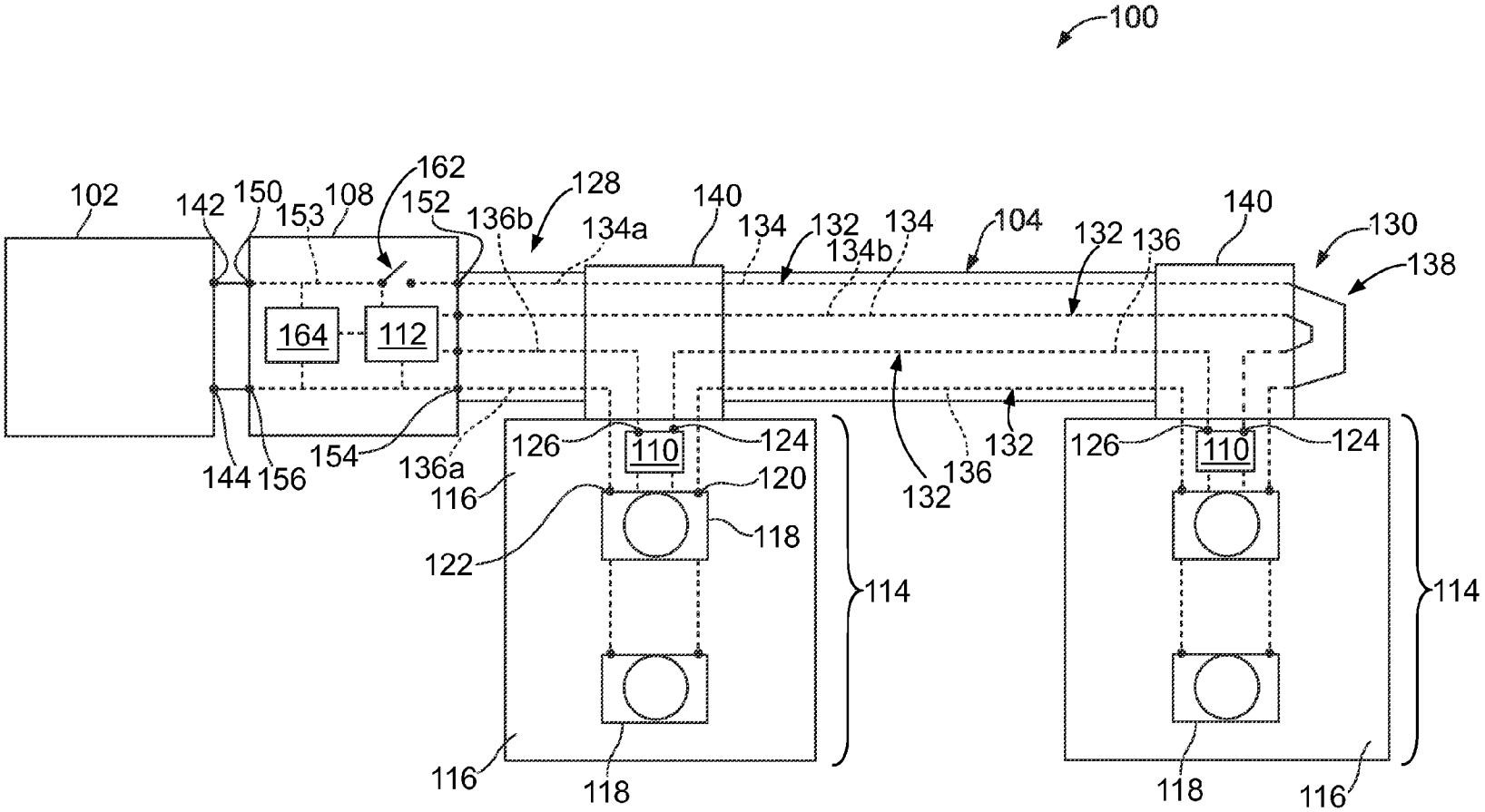
FIG. 1 is a schematic view of an exemplary embodiment of a light emitting diode (LED) interconnection system.

FIG. 1 is a schematic view of a light emitting diode (LED) interconnection system 100 for a solid state lighting system. The system 100 includes a driver 102, a cable 104, one or more LED modules 114, and an electrical connector 108 for connecting the driver 102 to the LED modules 114. The driver 102 provides electrical power to the LED modules 114 for driving operation of the LED modules 114. The LED modules 114 include temperature sensors 110 that measure temperatures of at least a portion of the LED modules 114. As will be described below, the electrical connector 108 includes a temperature monitor and control (TMC) module 112 that controls the flow of electrical power from the driver 102 to the LED modules 114 based on the temperatures received from the temperature sensors 110.

In the exemplary embodiment, the system 100 includes a plurality of LED modules 114, wherein each LED module 114 includes a plurality of LEDs 118. But, the system 100 may include any number of the LED modules 114, including only a single LED module 114. Moreover, each LED module 114 may include any number of LEDs 118. In some embodiments, one or more LED modules 114 includes only a single LED 118. Optionally, the LEDs 118 are mounted on optional circuit boards 116 of the LED modules 114. Each LED module 114 includes one or more of the temperature sensors 110. Each LED 118 includes a power input 120 and a power output 122, while each temperature sensor 110 includes an input 124 and an output 126. The LEDs 118 are interconnected in parallel or series/parallel within each LED module 114.

In the exemplary embodiment, each LED module 114 includes a single temperature sensor 110 that is mounted on a circuit board 116 such that the temperature sensor 110 is configured to measure a temperature of the circuit board 116. But, the temperature sensors 110 may each be configured to measure a temperature of any portion(s) of the corresponding LED module 114. For example, a temperature sensor 110 may be configured to measure a temperature of a body of an LED 118, may be configured to measure a temperature of any other component of an LED module 114 (such as, but not limited to, a thermal pad, a heat sink, and/or the like), and/or the like. In some alternative embodiments, a temperature sensor 110 is configured to measure and/or determine a temperature at a junction (not shown) of p-type and n-type semiconductors of an LED 118. Each temperature sensor 110 may be an analog sensor or a digital sensor. In some alternative embodiments, one or more of the LED modules 114 may include a plurality of temperature sensors 110, each configured to measure a temperature of any portion(s) of the LED module 114. As used herein, a temperature "associated with an LED" is defined as a temperature of any portion of an LED module 114.

The cable 104 extends a length from an end 128 to an opposite termination end 130. The cable 104 includes conductive pathways 132 that extend along the length of the cable 104. Optionally, the cable 104 is a ribbon cable. The conductive pathways 132 include power pathways 134 and return pathways 136. The cable 104 may include any number of power pathways 134 and corresponding return pathways 136. A termination circuit 138 is provided at the termination end 130 of the cable 104. The termination circuit 138 joins each power pathway 134 to the corresponding return pathway 136. In alternative to the cable 104, individual wires (not shown) may be used. For example, in some alternative embodiments, the conductive pathways 132 are defined by two or more individual wires (which may or may not be insulated) rather than being grouped together in the cable 104. Each individual wire may include any number and/or type of the conductive pathways 132.

The LED modules 114 are electrically connected to the cable 104, for example using a connector 140. Specifically, for each LED module 114, power and return pathways **134*a* and 136*a* of the cable 104 are electrically connected to the power input 120 and the power output 122, respectively, of the LED 118 located at the end of the module 114 that is proximate the cable 104. Each subsequent LED 118 within the LED module 114 is electrically connected to power and return pathways 134*a* and 136*a* via the series connection with the previous LED 118 of the module 114. Similarly, and for each LED module 114, power and return pathways 134*b* and 136*b* of the cable 104 are electrically connected to the input 124 and the output 126, respectively, of the temperature sensor 110 Although not shown, the respective electrical connection between the power and return pathways 134*a* and 136*a* and the power inputs and outputs 120 and 122, respectively, are optionally routed through, on, along, and/or the like the circuit board 116, for example using one or more circuits, traces, contacts, conductors, pathways, and/or the like of the circuit board 116. Similarly, the respective electrical connection between the power and return pathways 134*b* and 136*b* and the inputs and outputs 124 and 126, respectively, are optionally routed through, on, along, and/or the like the circuit board 116, for example using one or more circuits, traces, contacts, and/or the like of the circuit board 116. The electrical connections between adjacent LEDs 118 within an LED module 114 are also optionally routed through, on, along, and/or the like the circuit board 116**.

The driver 102 provides electrical power for the system 100. For example, and as briefly described above, the driver 102 provides electrical power to the LED modules 114 for driving operation of the LED modules 114. In the exemplary embodiment, the driver 102 provides power as an electrical current. Optionally, the driver 102 includes a circuit board (not shown) that distributes the electrical power throughout the system 100. The driver 102 includes a power output 142 and a power return 144.

The electrical connector 108 is coupled between the driver 102 and the cable 104 for providing an electrical connection between the driver 102 and the cable 104. Specifically, and as will be described below, the end 128 of the cable 104 is mated with the electrical connector 108 and the electrical connector 108 is electrically connected to the driver 102. As will be described below, the electrical connector 108 electrically connects the power output 142 of the driver 102 to the power pathway **134*a* of the cable 104. The electrical connector 108 also electrically connects the power return 144 of the driver 102 to the return pathway 136*a* of the cable 104. The electrical connector 108 optionally provides a separable interface between the driver 102 and the cable 104**.

The general flow of electrical power through the system 100 will now be described. As can be seen in FIG. 1, the power pathway **134*a* of the cable 104 carries electrical power from the power output 142 of the driver 102 to the power inputs 120 of the LEDs 118. The return pathway 136*a* of the cable 104 carries electrical power from the power outputs 122 of the LEDs 118 to the power return 144 of the driver 102 to complete an electrical circuit between the driver 102 and the LEDs 118. The power pathway 134*b* of the cable 104 carries electrical power from the TMC module 112 of the electrical connector 108 to the inputs 124 of the temperature sensors 110, while the return pathway 136*b* of the cable 104 carries electrical power from the outputs 126 of the temperature sensors 110 to the TMC module 112 of the electrical connector 108**.

In some embodiments, a combination of the cable 104 and the LED modules 114 may be considered an "LED module", for example in embodiments wherein each of the LED modules 114 only includes a single LED 118. Although the LEDs 118 within each LED module 114 are shown and described herein as being mounted on a common circuit board 116, in some alternative embodiments one or more LEDs 118 within an LED module 114 may be mounted on a circuit board 116 that is discrete from the circuit board 116 on which one or more other LEDs 118 of the LED module 114 are mounted. In the exemplary embodiment, the power pathway 134*b* and the return pathway 136*b* are illustrated as being positioned inside the power pathway 134*a* and the return pathway 136*a*. But, the power pathway 134*b* and the return pathway 136*b* may alternatively be positioned outside the power pathway 134*a* and the return pathway 136*a*. Any other arrangement between the pathways 134*b* and 136*b* and the pathways 134*a* and 136*a* may be used.

Figure 2:
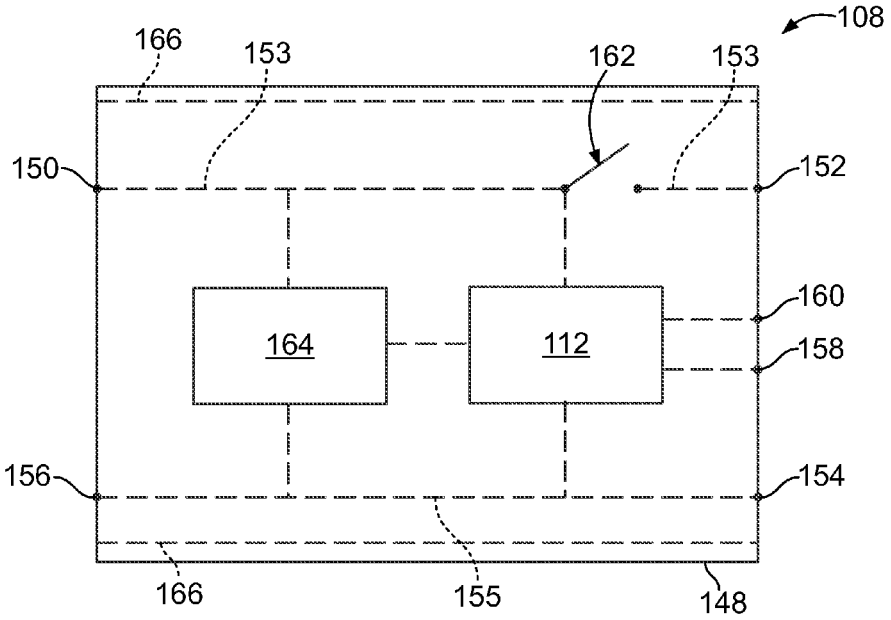
FIG. 2 is a schematic view of an exemplary embodiment of an electrical connector of the LED interconnection system shown in FIG. 1.

FIG. 2 is a schematic view of an exemplary embodiment of the electrical connector 108. The electrical connector 108 includes a housing 148, a plurality of electrical contacts held by the housing 148, and the TMC module 112. The electrical contacts of the electrical connector 108 include a driver input contact 150, an LED output contact 152, an LED return contact 154, a driver return contact 156, a temperature sensor input contact 158, and a temperature sensor output contact 160. Optionally, the driver input contact 150 and/or the driver return contact 156 is an insulation displacement contact (IDC). Other examples of the driver input contact 150 and the driver return contact 156 include, but are not limited to, crimp contacts, poke-in contacts, solder contacts, press-fit contacts, and/or the like.

The driver input contact 150 is electrically connected to the LED output contact 152 such that an electrical path 153 is defined between the contacts 150 and 152. In other words, an electrical path is defined from the driver input contact 150 to the LED output contact 152, and vice versa. The electrical path 153 defined between the driver input contact 150 and the LED output contact 152 is used to supply electrical power from the driver 102 (FIG. 1) to the power inputs 120 of the LEDs 118 (FIG. 1). Specifically, when the electrical connector 108 is electrically connected to the driver 102, the driver input contact 150 is electrically connected to the power output 142 (FIGS. 1) of the driver 102 for receiving electrical power therefrom. When the electrical connector 108 is electrically connected to the cable 104 (FIGS. 1 and 4), the LED output contact 152 is electrically connected to the power pathway 134*a* (FIG. 1) to supply electrical power from the driver 102 to the power pathway 134*a*.

The LED return contact 154 of the electrical connector 108 is electrically connected to the driver return contact 156 of the connector 108 such that an electrical path 155 is defined between the contacts 154 and 156. The electrical path 155 defined between the driver return contact 156 and the LED return contact 154 is used as a return path of electrical power from the LEDs 118 to the driver 102. Specifically, when the electrical connector 108 is electrically connected to the cable 104, the LED return contact 154 is electrically connected to the return pathway 136*a* (FIG. 1) to receive electrical power from the return pathway 136*a*. When the electrical connector 108 is electrically connected to the driver 102, the driver return contact 156 is electrically connected to the power return 144 (FIG. 1) of the driver 102 for completing the electrical power circuit between the driver 102 and the LEDs 118. The LED return contact 154 and the driver return contact 156 may be a single integral structure (e.g., the contacts 154 and 156 are defined by opposite ends of the same structure). Alternatively, the LED return contact 154 and the driver return contact 156 are discrete structures that are electrically connected via an intervening structure, such as, but not limited to, using one or more circuits, traces, contacts, conductors, pathways, and/or the like of the circuit board 116.

The temperature sensor input contact 158 and the temperature sensor output contact 160 are each electrically connected to the TMC module 112. When the electrical connector 108 is electrically connected to the cable 104, the temperature sensor output contact 160 is electrically connected to the power pathway 134*b* (FIG. 1) for supplying the temperature sensors 110 (FIG. 1) with electrical power to drive operation of the temperature sensors 110. The temperature sensor input contact 158 is electrically connected to the return pathway 136*b* (FIG. 1) for receiving signals that represent temperatures measured by the temperature sensors 110. The TMC module 112 is thereby operatively connected to the temperature sensors 110 for receiving measured temperatures associated with the LEDs 118.

As described above, the TMC module 112 controls the flow of electrical power from the driver 102 to the LED modules 114 based on the temperatures received from the temperature sensors 110. For example, the TMC module 112 is configured to prevent the flow of electrical power from the driver 102 to the LED modules 114 to shut down operation of the LEDs 118. The TMC module 112 is also configured to enable the flow of electrical power from the driver 102 to the LED modules 114 to enable operation of the LEDs 118. Moreover, the TMC module 112 may be configured to reduce an amount of electrical power flowing from the driver 102 to the LED modules 114 to supply the LEDs 118 with less electrical power.

In the exemplary embodiment, the TMC module 112 controls the supply of electrical power to the LED modules 114 by controlling the flow of electrical power from the driver input contact 150 to the LED output contact 152 of the electrical connector 108. Specifically, the TMC module 112 is operatively connected to the electrical path 153 of the electrical connector 108 such that the TMC module 112 is configured to selectively open and close the electrical path 153 and thereby prevent and enable, respectively, the flow electrical power from the driver input contact 150 to the LED output contact 152.

In the exemplary embodiment, the TMC module 112 is operatively connected to the electrical path 153 using an optional switch 162. The switch 162 is operatively connected within the electrical path 153 for selectively opening and closing the electrical path 153. The TMC module 112 selectively opens and closes the switch 162 to control the flow of electrical power from the driver input contact 150 to the LED output contact 152. The switch 162 may be any type of switch, such as, but not limited to, a metal-oxide-semiconductor field-effect transistor (MOSFET) and/or the like. In addition or alternatively to the switch 162, the TMC module 112 may be operatively connected to the electrical path 153 for controlling the flow of electrical power from the driver input contact 150 to the LED output contact 152 using any other component, structure, element, and/or the like, such as, but not limited to, an integrated circuit and/or the like.

The electrical connector 108 includes an optional driver monitor (DM) module 164 that is operatively connected to the electrical path 153 between the driver input contact 150 and the LED output contact 152 of the electrical connector 108. The DM module 164 is also operatively connected to the TMC module 112. The DM module 164 is configured to monitor the electrical path 153 to determine whether electrical power is flowing along the path 153 from the driver input contact 150 to the LED output contact 152 of the electrical connector 108. The DM module 164 communicates the determination of whether electrical power is flowing along the path 153 to the TMC module 112. The determination of whether electrical power is flowing along the path 153 indicates to the TMC module 112 that the LEDs 118 are turned on or off. The determination of whether electrical power is flowing along the path 153 may also indicate to the TMC module 112 whether the switch 162 has responded to an open or close command from the TMC module 112.

Optionally, the DM module 164 may be used as an over-voltage protection device for the LEDs 118. Specifically, the DM module 164 may be configured to detect the voltage level of electrical power flowing along the path 153 from the driver input contact 150 to the LED output contact 152. If the voltage level of electrical power being supplied to the LEDs 118 is at or exceeds a level that may cause damage to the LEDs 118 (e.g., is greater than a predetermined threshold), the DM module 164 instructs the TMC module 112 to prevent or reduce the flow of electrical power to the LED output contact 152. For example, the TMC module 112 may prevent the flow of electrical power to the LED output contact 152 prevent the LEDs 118 from receiving electrical power. Alternatively, the TMC module 112 may reduce the flow of electrical power to the LED output contact 152 to supply the LEDs 118 with less voltage. Accordingly, the DM module 164 may prevent the LEDs 118 from being damaged from an over-voltage condition.

One or more of the various components of the electrical connector 108 is optionally a component of, and/or disposed on and/or within, a circuit board. For example, in the exemplary embodiment, the electrical connector 108 includes a circuit board 166 held by the housing 148. The circuit board includes the contacts 150, 152, 154, 156, 158, and 160. More specifically, the driver input and LED output contacts 150 and 152, respectively, are mounted on the circuit board 166 and electrically connected to each other via electrical circuitry (not shown) of the circuit board 166 that defines the path 153 (the switch 162 also defines a portion of the path 153). Similarly, the LED return and driver return contacts 154 and 156, respectively, are mounted on the circuit board 166 and electrically connected to each other via circuitry (not shown) of the circuit board 166 that defines the path 155. The temperature sensor input and output contacts 158 and 160, respectively, are also mounted on the circuit board 166 and electrically connected to the TMC module 112 via electrical circuitry (not shown) of the circuit board 166. In the exemplary embodiment, the TMC module 112, the switch 162, and the DM module 164 are each mounted on the circuit board 166 and interconnected as described above and shown in FIG. 2 using electrical circuitry (not shown) of the circuit board 166. In some alternative embodiments, the electrical connector 108 does not include a circuit board. For example, in some alternative embodiments the electrical connector 108 may include a lead frame (not shown) wherein one or more various components of the electrical connector 108 is engaged with the lead frame.

Figure 3:
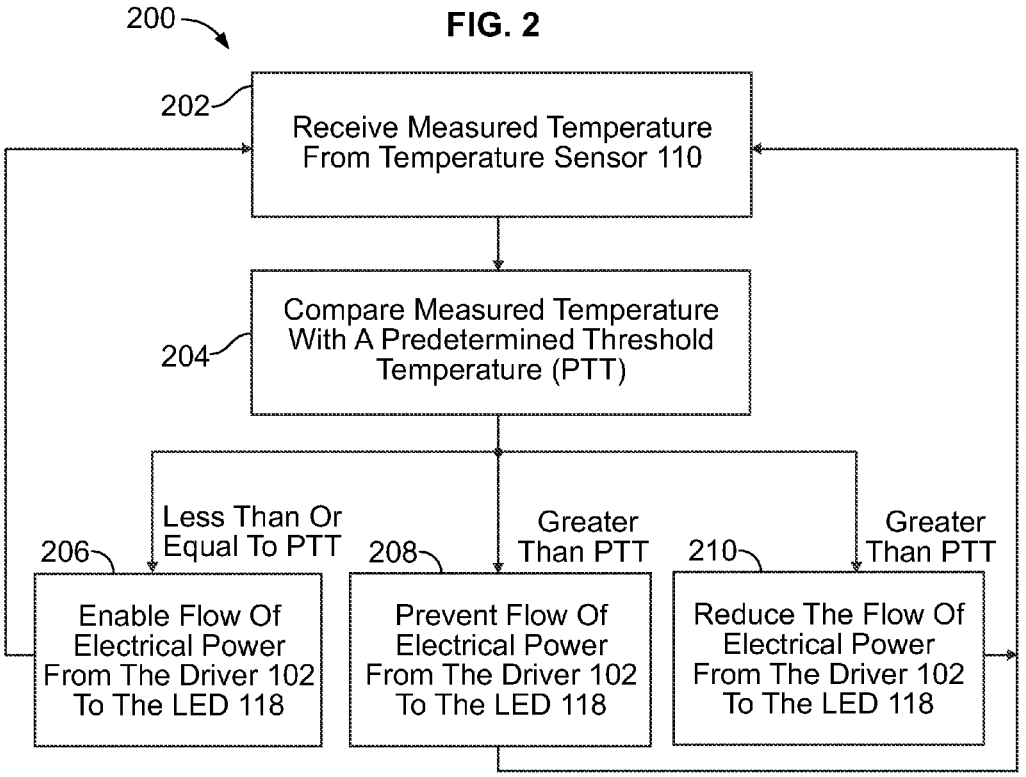
FIG. 3 is a flowchart illustrating an exemplary embodiment of a method for controlling the flow of electrical power to LEDs of the system shown in FIG. 1 using the electrical connector shown in FIG. 2.

FIG. 3 is a flowchart illustrating an exemplary embodiment of a method 200 for controlling the flow of electrical power to the LEDs 118 using the electrical connector 108. Referring now to FIGS. 1 and 3, in some embodiments, the LED modules 114 are receiving electrical power (i.e., are operating) at the beginning of the method 200. In other embodiments, the LED modules 114 are not receiving electrical power (i.e., are not operating) at the beginning of the method 200. If the LED modules 114 are not receiving electrical power at the beginning of the method 200, the method 200 may include an initialization step wherein operation of the TMC module 112 is initialized and the switch 162 is in the open position. The method 200 includes receiving 202, at the TMC module 112, at least one measured temperature from at least one of the temperature sensors 110. Optionally, the measured temperatures received by the TMC module 112 are signal conditioned by the temperature sensors 110, the TMC module 112, or an optional intervening component (not shown). In some embodiments, a measured temperature received by the TMC module 112 is an actual temperature, while in other embodiments the measured temperature received by the TMC module 112 is a signal that represents a measured temperature (such as, but not limited to, a measured electrical resistance of the temperature sensor 110, a voltage output of the temperature sensor 110, and/or the like). In some embodiments, the TMC module 112 is configured to determine a junction temperature of an LED 118 based on the measured temperature received from the corresponding temperature sensor 110. In such embodiments, the TMC module 112 may use the determined junction temperature as the "measured temperature" in the comparison step 204 described below. As described above, in some embodiments a measured temperature received by the TMC module 112 is an actual junction temperature or is a signal that represents a measured junction temperature.

The TMC module 112 compares 204 the measured temperature received from the temperature sensor 110 with a predetermined threshold temperature (PTT). The PTT may be a temperature at the measurement location on the corresponding LED module 114 that may cause damage to the corresponding LED 118. For example, if the temperature at the measured location of the LED module 114 is equal to or greater than the PTT, the LED 118 may experience light output degradation caused by overheating of the LED 118. Optionally, a factor of safety is built into the PTT.

If the measured temperature received by the TMC module 112 is less than or equal to the PTT, the TMC module 112 enables 206 the flow of electrical power from the driver 102 to the LEDs 118. The TMC module 112 thereby enables operation of the LEDs 118 because the measured temperature indicated that the temperatures of the LEDs 118 was within acceptable levels. To enable 206 the flow of electrical power from the driver 102 to LEDs 118, the TMC module 112 either closes the electrical path 153 or maintains the electrical path 153 as closed by either closing the switch 162 or maintaining the switch 162 in the closed position, respectively. Whether or not the TMC module 112 closes or maintains the electrical path 153 closed depends on whether the LEDs 118 are currently not receiving electrical power (i.e., are not operating) or are currently receiving electrical power (i.e., are operating). After enabling 206 the flow of electrical power from the driver 102 to the LEDs 118, the method 200 may return to the receiving step 202 such that the TMC module 112 continues to monitor the temperatures of the LEDs 118.

Returning again to the comparison step 204, if the measured temperature received by the TMC module 112 is greater than the PTT, the TMC module 112 either prevents 208 the flow of electrical power from the driver 102 to the LED modules 114 or reduces 210 the amount of electrical power flowing from the driver 102 to the LED modules 114. To prevent the flow of electrical power from the driver 102 to LEDs 118, the TMC module 112 either opens the electrical path 153 or maintains the electrical path 153 as open by either opening the switch 162 or maintaining the switch 162 in the open position, respectively. The TMC module 112 thereby shuts down operation of the LEDs 118 or maintains the non-operational state of the LEDs 118 to prevent the LEDs 118 from overheating. After preventing 208 the flow of electrical power from the driver 102 to the LEDs 118, the method 200 may return to the receiving step 202 such that the TMC module 112 continues to monitor the temperatures of the LEDs 118. To reduce the flow of electrical power from the driver 102 to LEDs 118, the TMC module 112 repeatedly opens and closes the electrical path 153 by repeatedly opening and closing the switch 162, for example by pulsing the switch 162. The TMC module 112 thereby reduces the amount of electrical power being supplied to the LEDs 118 to prevent the LEDs 118 from overheating. After reducing 210 the flow of electrical power from the driver 102 to the LEDs 118, the method 200 may return to the receiving step 202 such that the TMC module 112 continues to monitor the temperatures of the LEDs 118.

Figure 4:
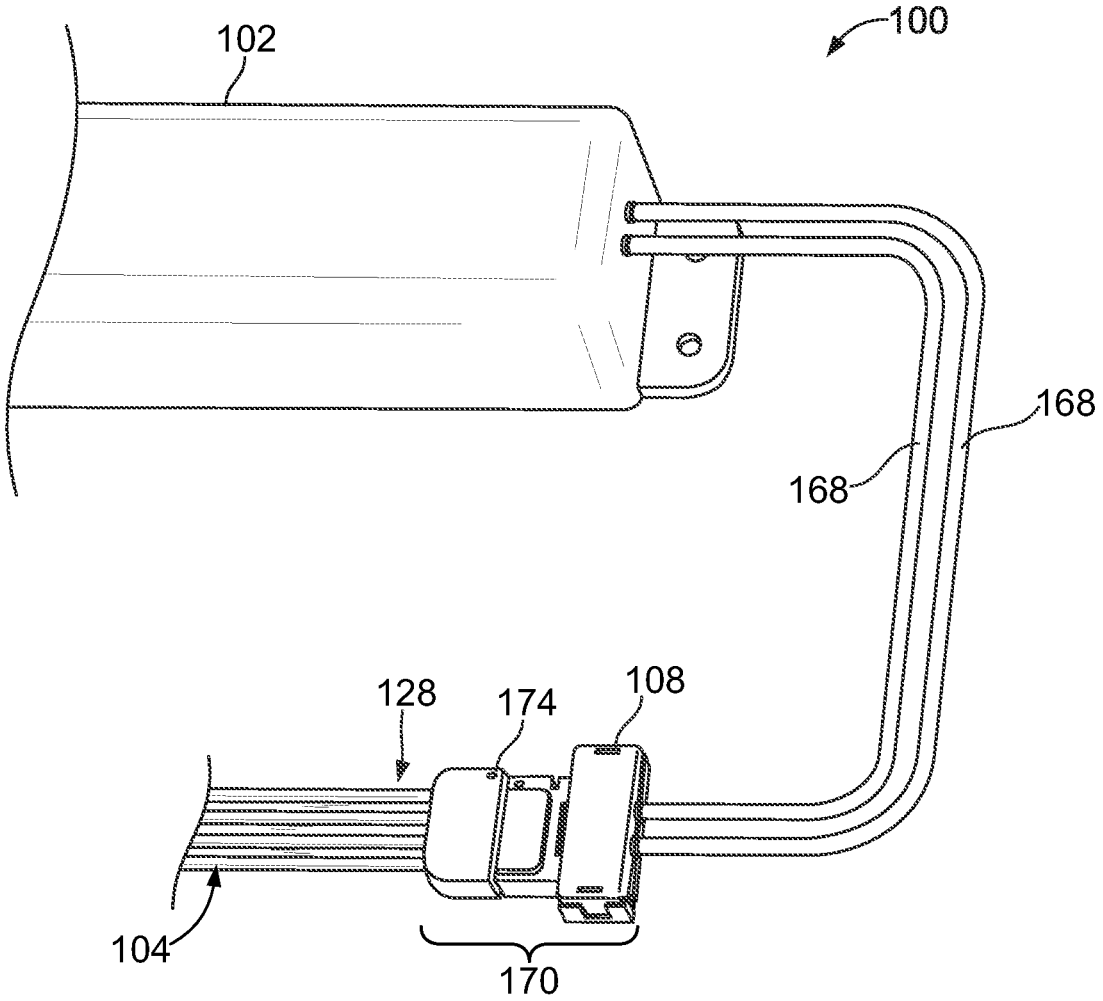
FIG. 4 is a perspective view of a portion of the LED interconnection system shown in FIG. 1 illustrating a separable connection between a driver and a cable of the system.

FIG. 4 is a perspective view of a portion of the system 100 illustrating a separable connection between the driver 102 and the cable 104 provided by the electrical connector 108. The driver 102 includes electrical wires 168 that extend from the contacts 142 and 144 (FIG. 1) of the driver 102 to the contacts 150 and 156 (FIGS. 1 and 2), respectively, of the electrical connector 108. The cable 104 and the wires 168 of the driver 102 are joined with a wire-to-wire plug assembly 170. The wire-to-wire plug assembly 170 includes the electrical connector 108 and a mating connector 174 that terminates the end 128 of the cable 104. In the exemplary embodiment, the electrical connector 108 is configured as a jack and the mating connector 174 is configured as a plug. Alternatively, the electrical connector 108 may be configured as a plug and the mating connector 174 may be configured as a jack. The electrical connector 108 and the mating connector 174 are configured to separabely mate together to electrically connect the driver 102 to the cable 104. In some alternative embodiments, the driver 102 does not include the wires 168, but rather the electrical connector 108 is directly electrically connected to the contacts 142 and 144 of the driver 102.

Various embodiments provide a system and method for preventing an LED from overheating to thereby facilitate the LED from being damaged. For example, various embodiments provide a system and method for preventing an LED from overheating to thereby facilitate preventing the LED from experiencing an increased rate of light output degradation. By practicing at least one of the embodiments, the flow of electrical power from a driver to an LED can be controlled by an electrical connector that electrically connects the driver to the LED. A technical effect of at least one embodiment is that the flow of electrical power from a driver to an LED can be controlled to prevent an increased rate of light output degradation of the LED. The embodiments described and/or illustrated herein may provide a closed loop system where an LED is protected from an over-temperature condition to thereby extend a lifetime of the LED. The embodiments described and/or illustrated herein may provide an LED interconnection that is capable of interchangeably using standard, off-the-shelf, drivers.

The foregoing detailed description of certain embodiments of the subject matter described and/or illustrated herein will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or a block of random access memory, hard disk, or the like) or multiple pieces of hardware. Similarly, the functionality of the modules and/or other components described and/or illustrated herein may be stand alone programs, may be incorporated as subroutines in an operating system, may be functions in an installed software package, and the like. It should be understood that the various embodiments are not limited to the arrangements and instrumentality shown and/or described herein.

The modules of the various embodiments described and/or illustrated herein may be implemented in hardware, software or a combination thereof. The modules described and/or illustrated herein may be implemented utilizing any combination of dedicated hardware boards, DSPs, processors, etc. Alternatively, the modules described and/or illustrated herein may be implemented utilizing an off-the-shelf PC with a single processor or multiple processors wherein the functional operations distributed between the processors. As a further option, the modules described and/or illustrated herein may be implemented utilizing a hybrid configuration in which certain modular functions are performed utilizing dedicated hardware, while the remaining modular functions are performed utilizing an off-the shelf PC and/or the like. The modules described and/or illustrated herein also may be implemented as software modules within a processing unit. The modules described and/or illustrated herein may be implemented as part of one or more computers or processors. The computer or processor may include a computing device, an input device, a display module and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a floppy disk drive, optical disk drive, and the like. The storage device may also be other similar means for loading computer programs or other instructions into the computer or processor.

As used herein, the term "computer" or "module" may include any processor-based or microprocessor-based system including systems using microcontrollers, reduced instruction set computers (RISC), ASICs, logic circuits, and any other circuit or processor capable of executing the functions described herein. The above examples are exemplary only, and are thus not intended to limit in any way the definition and/or meaning of the terms "computer" or "module".

The computer or processor executes a set of instructions that are stored in one or more storage elements, in order to process input data. The storage elements may also store data or other information as desired or needed. The storage element may be in the form of an information source or a physical memory element within a processing machine. The set of instructions may include various commands that instruct the computer or processor as a processing machine to perform specific operations such as the methods, steps, and/or processes of the various embodiments described and/or illustrated herein. The set of instructions may be in the form of a software program. The software may be in various forms such as system software or application software and which may be embodied as a tangible and non-transitory computer readable medium. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the subject matter described and/or illustrated herein is intended to be illustrative, and not restrictive. For example, the above-described embodiments (and/or aspects thereof) may be used in combination with each other. Furthermore, references to an "embodiment" are not intended to be interpreted as excluding the existence of additional embodiments that also incorporate the recited features. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, unless explicitly stated to the contrary, embodiments "comprising" or "having" an element or a plurality of elements having a particular property may include additional such elements not having that property. As used herein, an element or step recited in the singular and proceeded with the word "a" or "an" should be understood as not excluding plural of said elements or steps, unless such exclusion is explicitly stated. Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for connecting a light emitting diode (LED) to a driver, said electrical connector comprising:

a housing;

a driver input contact held by the housing and configured to be electrically connected to a power output of the driver;

a driver return contact held by the housing and configured to be electrically connected to a power return of the driver;

an LED output contact held by the housing and configured to be electrically connected to a power input of the LED, an electrical path being defined between the driver input contact and the LED output contact for supplying electrical power from the driver to the power input of the LED;

an LED return contact held by the housing and configured to be electrically connected to a power output of the LED; and a temperature monitor and control (TMC) module operatively connected to a temperature sensor for receiving a temperature associated with the LED, the TMC module being configured to control the flow of electrical power from the driver input contact to the LED output contact based on the temperature received from the temperature sensor.

2. The electrical connector according to claim 1, wherein the TMC module is configured to control the flow of electrical power from the driver input contact to the LED output contact by at least one of:

opening the electrical path between the driver input contact and the LED output contact to prevent the flow of electrical power from the driver input contact to the LED output contact;

closing the electrical path between the driver input contact and the LED output contact to enable the flow of electrical power from the driver input contact to the LED output contact; or repeatedly opening and closing the electrical path between the driver input contact and the LED output contact to decrease the flow of electrical power from the driver input contact to the LED output contact as compared to a closed electrical path between the driver input contact and the LED output contact.

3. The electrical connector according to claim 1, wherein the TMC module is configured to open the electrical path between the driver input contact and the LED output contact to prevent the flow of electrical power from the driver input contact to the LED output contact when the temperature received from the temperature sensor is one of equal to or greater than a predetermined threshold.

4. The electrical connector according to claim 1, wherein the TMC module comprises a switch operatively connected within the electrical path between the LED output contact and the driver input contact, the TMC module being operatively connected to the switch such that the TMC module is configured to selectively open and close the switch to control the flow of electrical power from the driver input contact to the LED output contact.

5. The electrical connector according to claim 1, further comprising a driver monitor module operatively connected to the electrical path between the driver input contact and the LED output contact, the driver monitor module being configured to at least one of:

determine whether the electrical path between the driver input contact and the LED output contact is open or closed; or monitor a voltage level of the electrical path between the driver input contact and the LED output contact.

6. The electrical connector according to claim 1, further comprising a temperature sensor input contact held by the housing and a temperature sensor output contact held by the housing, the temperature sensor input contact being configured to be electrically connected to an output of the temperature sensor, the temperature sensor output contact being configured to be electrically connected to an input of the temperature sensor.

7. The electrical connector according to claim 1, wherein the LED output contact is configured to engage one of a contact that terminates a cable or an electrical conductor of the cable, the electrical connector being configured to provide a separable interface between the driver and the cable.

8. An electrical connector for connecting a light emitting diode (LED) to a driver. said electrical connector comprising:

a housing;

a driver input contact held by the housing and configured to be electrically connected to a power output of the driver;

an LED output contact held by the housing and configured to be electrically connected to a power input of the LED, an electrical path being defined between the driver input contact and the LED output contact for supplying electrical power from the driver to the power input of the LED;

a temperature monitor and control (TMC) module operatively connected to a temperature sensor for receiving a temperature associated with the LED, the TMC module being configured to control the flow of electrical power from the driver input contact to the LED output contact based on the temperature received from the temperature sensor; and a circuit board held by the housing, the circuit board comprising the driver input contact, the LED output contact, and electrical circuitry that electrically connects the driver input contact to the LED output contact to thereby provide the electrical path between the driver input contact and the LED output contact.

9. A light emitting diode (LED) interconnection system comprising:

an LED module having an LEI) and a temperature sensor, the LED includes a power input, the temperature sensor being configured to measure a temperature of at least a portion of the LED module; and an electrical connector for connecting the LED module to a driver, the electrical connector comprising:

a driver input contact configured to be electrically connected to a power output of the driver;

an LED output contact electrically connected to the power input of the LED, an electrical path being defined between the driver input contact and the LED output contact for supplying electrical power from the driver to the power input of the LED; and a temperature monitor and control (TMC) module operatively connected to the temperature sensor for receiving the measured temperature of the at least a portion of the LED module, the TMC module being configured to control the flow of electrical power from the driver input contact to the LED output contact based on the measured temperature received from the temperature sensor.

10. The LED interconnection system according to claim 9, wherein the TMC module comprises a switch operatively connected within the electrical path between the LED output contact and the driver input contact, the TMC module being operatively connected to the switch such that the TMC module is configured to selectively open and close the switch to control the flow of electrical power from the driver input contact to the LED output contact.

11. The LED interconnection system according to claim 9, wherein the electrical connector further comprises a driver monitor module operatively connected to the electrical path between the driver input contact and the LED output contact, the driver monitor module being configured to at least one of:

determine whether the electrical path between the driver input contact and the LED output contact is open or closed; or monitor a voltage level of the electrical path between the driver input contact and the LED output contact.

12. The LED interconnection system according to claim 9, further comprising a plurality of LED modules interconnected in series, each LED module comprising at least one of the LEDs.

13. The LED interconnection system according to claim 9, wherein the TMC module is configured to control the flow of electrical power from the driver input contact to the LED output contact by at least one of:

opening the electrical path between the driver input contact and the LED output contact to prevent the flow of electrical power from the driver input contact to the LED output contact;

closing the electrical path between the driver input contact and the LED output contact to enable the flow of electrical power from the driver input contact to the LED output contact; or repeatedly opening and closing the electrical path between the driver input contact and the LED output contact to decrease the flow of electrical power from the driver input contact to the LED output contact as compared to a closed electrical path between the driver input contact and the LED output contact.

14. The LED interconnection system according to claim 9, wherein the TMC module is configured to open the electrical path between the driver input contact and the LED output contact to prevent the flow of electrical power from the driver input contact to the LED output contact when the temperature received from the temperature sensor is one of equal to or greater than a predetermined threshold.

15. The LED interconnection system according to claim 9, wherein the TMC module is operatively connected to the temperature sensor through an electrical path that does not include the LED output contact and that does not include the LED return contact.

16. The LED interconnection system according to claim 9, wherein the temperature sensor is not a component of the electrical connector.

17. A light emitting diode (LED) interconnection system comprising:

a driver configured to generate electrical power, the driver having a power output;

an LED module having an LED and a temperature sensor, the LED includes a power input, the temperature sensor being configured to measure a temperature of at least a portion of the LED module; and an electrical connector for connecting the LED to the driver, the electrical connector comprising:

a driver input contact electrically connected to the power output of the driver;

an LED output contact electrically connected to the power input of the LED, an electrical path being defined between the driver input contact and the LED output contact for supplying electrical power from the driver to the power input of the LED; and a temperature monitor and control (TMC) module operatively connected to the temperature sensor for receiving the measured temperature of the at least a portion of the LED module, the TMC module being configured to control the flow of electrical power from the driver input contact to the LED output contact based on the measured temperature received from the temperature sensor, wherein the TMC module is configured to open the electrical path between the driver input contact and the LED output contact to prevent the flow of electrical power from the driver input contact to the LED output contact when the temperature received from the temperature sensor is one of equal to or greater than a predetermined threshold.

18. The LED interconnection system according to claim 17, wherein the TMC module comprises a switch operatively connected within the electrical path between the LED output contact and the driver input contact, the TMC module being operatively connected to the switch such that the TMC module is configured to selectively open and close the switch to control the flow of electrical power from the driver input contact to the LED output contact.

19. The LED interconnection system according to claim 17, wherein the electrical connector further comprises a driver monitor module operatively connected to the electrical path between the driver input contact and the LED output contact, the driver monitor module being configured to at least one of:

determine whether the electrical path between the driver input contact and the LED output contact is open or closed; or monitor a voltage level of the electrical path between the driver input contact and the LED output contact.

20. The LED interconnection system according to claim 17, further comprising a cable electrically connected to the power input of the LED, the LED output contact being configured to engage one of a contact that terminates the cable or an electrical conductor of the cable, the electrical connector being coupled between the cable and the driver and providing a separable interlace between the driver and the cable.

* * * * *